US005851744A

United States Patent [19]

Suzuki et al.

[11] Patent Number: 5,851,744

[45] Date of Patent: Dec. 22, 1998

[54] PHOTOGRAPHIC FILM

[75] Inventors: Fumiyuki Suzuki; Takahito Miyoshi; Yukio Shirokura; Takanori Sato; Hiroko Sugihara, all of Shizuoka, Japan

[73] Assignee: Fuji Photo Film Co., Ltd., Kanagawa, Japan

[21] Appl. No.: 917,770

[22] Filed: Aug. 27, 1997

[30] Foreign Application Priority Data

Aug. 27, 1996 [JP] Japan ..... 8-245594

[51] Int. Cl.[6] ..... G03C 1/795

[52] U.S. Cl. ..... 430/501; 430/533; 430/496

[58] Field of Search ..... 430/501, 533, 430/496

[56] References Cited

U.S. PATENT DOCUMENTS

| | | | |
|---|---|---|---|
| 5,254,445 | 10/1993 | Takamuki et al. | 430/501 |
| 5,326,689 | 7/1994 | Murayama | 430/530 |
| 5,360,708 | 11/1994 | Takada et al. | 430/496 |
| 5,462,824 | 10/1995 | Kawamoto et al. | 430/501 |
| 5,472,831 | 12/1995 | Nishiura et al. | 430/501 |
| 5,496,687 | 3/1996 | Kawamoto | 430/496 |
| 5,496,688 | 3/1996 | Okamoto et al. | 430/500 |
| 5,567,576 | 10/1996 | Suzuki et al. | 430/533 |
| 5,580,707 | 12/1996 | Kawamoto | 430/496 |
| 5,629,141 | 5/1997 | Kawamoto | 430/495.1 |

*Primary Examiner*—Mark F. Huff

*Attorney, Agent, or Firm*—Sixbey, Friedman, Leedom & Ferguson, P.C.; Gerald J. Ferguson, Jr.

[57] ABSTRACT

A photographic film has a width of 35 mm and comprises a continuous support comprising polyester and at least one photographic layer provided thereon. The support has a thickness of 112 to 128 $\mu$m. The polyester has recurring units comprising 60 to 85 molar % of ethylene-2,6-naphthalate unit and 15 to 40 molar % of ethylene terephthalate unit and satisfies the formula (1):

$$-0.65 \leq [NDA] + \log [NET] \leq 0.28 \quad (1)$$

wherein [NDA] represents a ratio of a number of 2,6-naphthalate unit to a total number of 2,6-naphthalate unit and terephthalate unit, and [NET] represents a ratio of a number of ethylene unit which has a 2,6-naphthalate unit on one side and a terephthalate unit on the other side to a total number of an ethylene unit in the polyester.

5 Claims, 1 Drawing Sheet

PHOTOGRAPHIC FILM

FIELD OF THE INVENTION

The present invention relates to a photographic film having a width of 35 mm which is favorably employed for a still photographic film for a standard shooting camera, and especially the invention relates to a photographic film named for a 135 type film.

BACKGROUND OF THE INVENTION

A photographic film (i.e., silver halide photographic film) is generally produced by coating one or more photographic layers (light-sensitive emulsion layers) on a plastic film support. As the plastic film support, celluloses films such as triacetyl cellulose (hereinafter referred to as "TAC film") or polyesters such as polyethylene terephthalate (hereinafter referred to as "PET film") are generally employed.

A photographic film is generally classified into two groups: films in the form of a rectangular sheet such as an X-ray film, a film for photomechanical process or a cut film; and films in the form of rolled strip such as a color or black-and-white photographic film having a width of 35 mm or less which is incorporated into a cylindrical cartridge (i.e., patrone). Particularly, a photographic film having a width of 35 mm for producing still image is widely employed and is as a known 135 type film: which is a negative or positive film for a shooting camera.

As material of the support for the 135 type film, triacetyl cellulose (TAC) is mainly employed. The TAC has a high transparency and essentially no optical anisotropy, and further has a property of being easily decreased on the curl of the film after development (easily curl-decreasing property).

The TAC film is prepared by dissolving TAC in an organic solvent such as dichloromethane, casting the TAC solution on a metallic belt (roll) and drying the casted solution film. Thus, the preparation of TAC film needs an organic solvent.

As materials capable of forming a film using no organic solvent, polyethylene terephthalate (PET) and polyethylene-2, 6-naphthalate (PEN) are known.

The PET film is, for example, prepared by melting PET under heating, extruding the melted PET and stretching biaxially the extruded PET to form a PET film. The stretched PET film is employed as an X-ray film or a lith film. The PET film has a disadvantageous feature in that the curl once produced in a patrone does not easily diminish.

Therefore, in the case that a photographic film using a PET support is used in the form of rolled strip (e.g., the 135 type film), scratching occurs on the produced image or the image shows conditions of "out-of-focusing", or jamming occurs during feeding of the film in the printing step.

It is known that PEN (polyethylene-2,6-naphthalate) gives a hard film having a high strength. The PEN film is useful as a thin support which is used for a photographic film for Advanced Photo System (APS) or for a film-incorporated camera (EP 0606070 A1).

However, if the PEN film is employed as the support of the 135 type film, troubles such as jamming occur when the 135 type film is automatically loaded or wound up in a camera. Therefore, further studies for application of PEN film to a support for the 135 type film have not been made.

SUMMARY OF THE INVENTION

It is an object of the present invention to provide a still photographic film having a width of 35 mm (e.g., a 135 type film) using a support which can be prepared using no organic solvent.

It is another object of the invention to provide a still photographic film having a width of 35 mm and using a support which comprises polyester having main recurring unit of ethylene-2,6-naphthalate.

It is a further object of the invention to provide a still photographic film having a width of 35 mm which exhibits a reduced curling tendency and excellent handling properties.

The support for the 135 type film is required to have a relatively large thickness. However, a 135 type film using a PEN film causes troubles in automatically loading or winding up in a camera as mentioned previously. The present inventors have studied so as to employ PEN as the support for the 135 type film. As a result, it has been revealed that a terephthalate unit is incorporated into polyethylene-2,6-naphthalate (PEN) to a certain extent and set to have ester bonding conditions to satisfy the specific condition of the formula (1), which results in relaxation of hardness originated from PEN. Hence, the resultant polyester film meets the requirements for the support of 135 type film.

There is provided by the present invention a photographic film having a width of 35 mm which comprises a continuous support comprising polyester and at least one photographic layer provided thereon, wherein the polyester has recurring units comprising 60 to 85 molar % of ethylene-2,6-naphthalate unit and 15 to 40 molar % of ethylene terephthalate unit and satisfies the formula (1):

$$-0.65 \leqq [NDA] + \log [NET] \leqq 0.28 \quad (1)$$

wherein [NDA] represents a ratio of a number of 2,6-naphthalate unit to a total number of 2,6-naphthalate unit and terephthalate unit, and [NET] represents a ratio of a number of ethylene unit which has a 2,6-naphthalate unit on one side (or one end) and a terephthalate unit on the other side (or the other end) to a total number of an ethylene unit in the polyester; and the support has a thickness of 112 to 128 $\mu$m.

The photographic film is suitable for a 135 type photographic film defined in "135 type film•patrone" of JIS K 7519-1982. The 135 type photographic film is required to have the dimension defined above and to be capable of being easily incorporatable into the patrone defined above. Further, it is required that the 135 type photographic film can be handled in a camera designed for 135 type film (roll film), and the photographed film shows good handling in a developing or fixing procedure.

JIS K 7519 corresponds to ANSI PH1.14 or ISO R1007 (ANSI: American National Standards Institute, Inc. ISO: International Organization for Standardization).

Preferred embodiments of the photographic film of the invention as follows:

1) The photographic film wherein the support is a biaxially stretched film.
2) The photographic film wherein the polyester has an intrinsic viscosity (limiting viscosity number) of 0.45 to 0.65.
3) The photographic film wherein the support further contains fine particles (preferably silica particles) having a mean particle size of 0.1 to 1 $\mu$m in an amount of 5 to 100 ppm.
4) The photographic film above 3) wherein the fine particles have a mean particle size distribution of 0.01 to 5 $\mu$m and contains particles of more than 1 $\mu$m in an amount of not more than 20% in the proportion in terms of area.

5) The photographic film wherein the support has a core-set curl value of not more than 40 $m^{-1}$ (preferably 5 to 40 $m^{-1}$).

6) The photographic film wherein the support has a loop stiffness of 25 to 50 g.

7) The photographic film wherein the polyester is prepared from a mixture of PEN and PET.

The photographic film of the invention is employed in the condition of being incorporated into a patrone. The photographic film placed into the camera shows good handling properties, i.e., is free from troubles in automatically loading or winding up in a camera. Further, in the developed image, occurrence of spots and out-of-focusing (out-of-focus) are scarcely found.

DETAILED DESCRIPTION OF THE INVENTION

Figure 1:
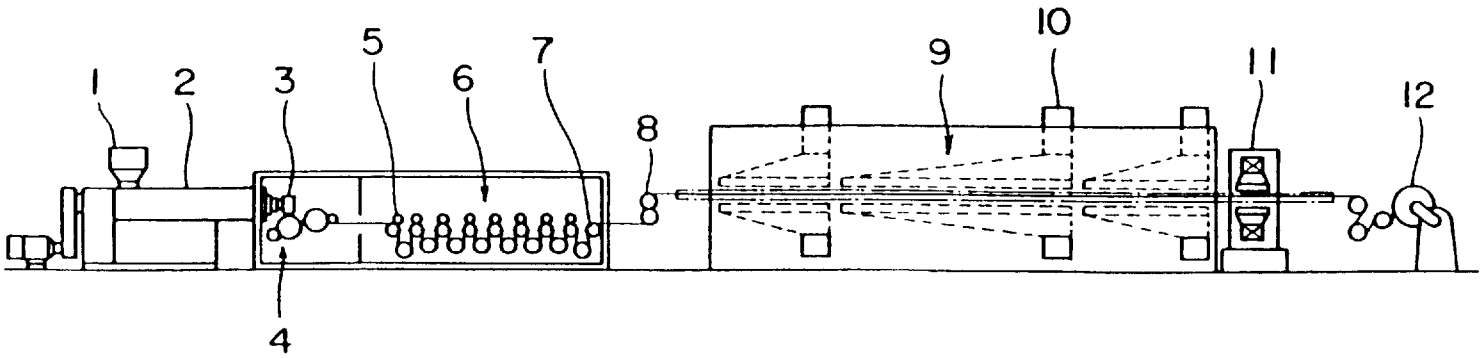
FIG. 1 illustrates an example of an apparatus employable for preparing the continuous polyester film of the invention.

The photographic film having a width of 35 mm of the invention comprises a continuous support comprising polyester and at least one photographic layer provided thereon. The polyester has recurring units comprising 60 to 85 molar % of an ethylene-2,6-naphthalate unit and 15 to 40 molar % of an ethylene terephthalate unit, and satisfies the formula (1) (which indicates ester bonding conditions of the polyester):

$$-0.65 \leqq [NDA] + \log [NET] \leqq 0.28 \quad (1)$$

wherein [NDA] represents a ratio of a number of a 2,6-naphthalate unit to a total number of a 2,6-naphthalate unit and a terephthalate unit, and [NET] represents a ratio of a number of an ethylene unit which has 2,6-naphthalate unit on one side and a terephthalate unit on the other side to a total number of an ethylene unit in the polyester. The "log" of log [NET] represents a common logarithm.

The support of the invention formed of the polyester has a thickness of 112 to 128 $\mu$m, which is suitable as a support of a 135 type film.

The ester bonding conditions represented by the formula (1) can be obtained, for example, by subjecting a copolymer comprising an ethylene-2,6-naphthalate unit and an ethylene terephthalate unit or a mixture of PEN and PET to heat treatment in a film-forming procedure including melting, extruding or stretching of the polyester. Therefore, the polyester film can be formed. of a mixture of PEN, PET or the copolymer.

The range of the thickness is designed to easy incorporate the photographic film into the patrone for 135 film, and to show good handling when the film is used in a camera for 135 film.

The formula (1) means that the unit of [NET] (i.e., —Ph—COO—$CH_2CH_2$—OCO—Naph— in which Ph is 1,4-phenylene unit and Naph is 2,6-naphthylene unit) should be present in an amount to a certain extent in the polyester comprising 60 to 85 molar % of ethylene-2,6-naphthalate unit and 15 to 40 molar % of ethylene terephthalate unit. For example, a polyester comprising a mixture of PEN and PET in the above proportion is required to contain the unit [NET] in at least 3 to 6 molar %.

The polyester film of the invention satisfying the above conditions exhibits a reduced curling tendency and excellent handling properties, and therefore is favorably employed as a support for 135 type film. The polyester film can be improved in various characteristics by subjecting to a biaxially stretching treatment.

Examples of polyesters employable for preparing the polyester film of the invention include PEN, PET, and copolymer consisting of an ethylene-2,6-naphthalate unit and an ethylene terephthalate unit.

The polyesters can be synthesized by a conventional method. For example, the synthesis is conducted by direct esterification of a dibasic acid and a glycol, or by interesterification of a dibasic acid a dialkylester and a glycol and remove of the released alcohol under heating and reduced pressure.

PEN (polyethylene-2,6-naphthalate) can be synthesized, for example, by reacting (polymerizing) 2,6-naphthalene dicarboxylic acid or its derivative (i.e., derivative capable of forming ester bond such as, dicarboxylic acid anhydride or lower alkyl ester) and ethylene glycol or its derivative (i.e., derivative capable of forming ester bond, such as alkylene oxide) and, further other dihydric alcohol if desired, under appropriate reaction conditions (e.g., under heating at appropriate temperature) in the presence of an appropriate catalyst.

PET (polyethylene terephthalate) can be synthesized, for example, by reacting (polymerizing) terephthalic acid or its derivative (i.e., derivative capable of forming ester bond, such as dicarboxylic acid anhydride or lower alkyl ester) and ethylene glycol or its derivative (i.e., derivative capable of forming ester bond, such as alkylene oxide), and further other dihydric alcohols if desired, under appropriate reaction conditions (e.g., under heating at appropriate temperature) in the presence of an appropriate catalyst.

The copolymer can be synthesized, for example, by reacting (polymerizing) 2,6-naphthalene dicarboxylic acid or its derivative, terephthalic acid or its derivative, and ethylene glycol or its derivative and, further other dihydric alcohol if desired, under appropriate reaction conditions (e.g., under heating at appropriate temperature) in the presence of an appropriate catalyst. The copolymer can be obtained by adding terephthalic acid or its derivative to a polymerizing mixture of 2,6-naphthalene dicarboxylic acid and ethylene glycol before completion of the polymerization.

Examples of dibasic acids other than the above-mentioned dibasic acids employable in the invention include bezene-dicarboxylic acids such as, isophthalic acid, phthalic acid, sodium isophthalic acid sulfonate (sodium solfoisophthalic acid), 2,7-naphthalene dicarboxylic acid, 1,5-naphthalene dicarboxylic acid, diphenyl dicarboxylic acid, diphenylether dicarboxylic acid and derivatives thereof (derivatives capable of forming ester bond such as dicarboxylic acids anhydride or lower alkyl esters); alicylic dicarboxylic acids such as, cyclopropane dicarboxylic acid, cyclobutane dicarboxylic acid, hexahydroterephthalic acid and derivatives thereof (derivatives capable of forming ester bond such as dicarboxylic acids anhydride or lower alkyl esters); and aliphatic dicarboxylic acids such as, succinic acid, adipic acid, oxalic acid, azelaic acid, sebasic acid, dimer acids and derivatives thereof (derivatives capable of forming ester bond such as, dicarboxylic acids anhydride or lower alkyl esters). These dicarboxylic acids can be employed in an amount of not more than 10 molar % based on the total amount of dicarboxylic acids.

Examples of dihydric alcohols other than ethylene glycol employable in the invention include propylene glycol, trimethylene glycol, diethylene glycol, teramethylene glycol, hexamethylene glycol, neopentyl glycol, p-xylene glycol, 1,4-cyclohexane dimethanol, bisphenol A, p,p'-dihydroxyphenylsulfone, 1,4-bis(β-hydroxyethoxyphenyl) propane, polyalkylene glycol (e.g., polyethylene glycol, polypropylene glycol) and p-phenylenebis (dimethylolcyclohexane). These dihydric alcohols can be employed in an amount of not more than 10 molar % based on the total amount of dihydric alcohol.

The hydroxyl or carboxy group at the terminal of the polyester may be terminated with a mono-functional compound such as benzoic acid, benzoylbenzoic acid, benzyloxybenzoic acid or methoxypolyalkylene glycol. Otherwise, the polyester may be denatured by a small amount of tri- or tetra- functional compound such as glycerol or pentaerythritol (i.e., so long as the polyester keeps a substantially linear structure).

In the synthesis of the polyester, known catalysts for esterification, interesterification or polymerization (polycondensation) can be employed. Further, known stabiizers, antioxidants, anti-static agents, lubricants, UV-absorbers, fluorescent brighteners, pigments, dyes, light shielding agents and filers may be employed.

The esterification can be proceeded without addition of a catalyst. However, catalysts for interesterification or polymerization described below is preferably employed. Examples of catalysts for interesterification include manganese acetate, cobalt acetate, magnesium acetate, calcium acetate, cadmium acetate, zinc acetate, lead acetate, magnesium oxide, and lead oxide. The catalyst can be employed singly, or in combination.

Examples of catalysts for polycondensation include antimony trioxide, antimony pentaoxide, antimony trifluoride, antimony sulfide, antimony tributyrate, antimony ethylene glycolate, potassium antimonate, antimony acetate, antimony trichloride, germanium dioxide, germanium trioxide, manganese acetate, zinc acetate, lead acetate, an alkali metal salt of benzoic acid, a titanium alkoxide (e.g., titanium butoxide) and an alkali metal salt of titanic acid. The catalyst can be employed singly, or in combination.

Examples of the stabilizers include phosphoric acid, phosphorous acid and esters thereof (e.g., trimethyl phosphate, triethyl phosphate, triphenyl phosphate, triphenyl phosphite, trimethyl phosphite, triethyl phosphite, and a monoester or diester of phosphoric acid or phosphorous acid).

As the antioxidants, hindered phenol compounds can be employed. Examples of the compounds include those commercially available as trade names of Irganox 1010 and Sumilizer BHT and GA-80. The compounds, which are primary antioxidant, can be combined with a secondary antioxidants. Example of the secondary antioxidants include those commercially available as trade names of Sumilizer TRL-R, TPM and TP-D.

The process for the preparation of polyester is further explained in detail. For example, a dicarboxylic acid such as 2,6-naphthalene dicarboxylic acid or dimethyl-2,6-naphthalene dicarboxylate and a dihydric alcohol such as ethylene glycol undergoes interesterification or esterification (which is generally carried out in an esterification vessel) to give an oligomer, and the oligomer is polymerized (polycondensed) in vaccuo (which is generally carried out in an polycondensation vessel).

The interesterification is generally performed by reacting a dicarboxylic acid alkylester and a dihydric alcohol at an atmospheric pressure or a pressure of 1 to 2 kg/cm$^2$ under heating at 180° to 280° C. (preferably 230° to 270° C.) for 0.5 to 8 hours (preferably 2 to 4 hours) and terminating the reaction when alcohol is completely removed. The esterification is generally performed by reacting a dicarboxylic acid and a dihydric alcohol under the same conditions as above and terminating the reaction when water is completely removed. The polymerization of the oligomer is generally performed by reducing the pressure in polymerization system (in the polycondensation vessel) to 50 to 1 mmHg, raising the temperature to the range of 240° to 290° C., further reducing the pressure to not higher than 1 mmHg if desired, and polymerizing the oligomer at the same temperature and the pressure for 1 to 3 hours.

The polyester film preferably contains inert fine particles as lubricant in an amount of not more than 300 ppm (preferably 5 to 100 ppm). Examples of the particles include inorganic compound particles such as talc particles, silica particles, aluminum oxide particles and calcium carbonate particles; and organic compound particles such as cross-linked acrylic resin particles and cross-linked benzoguanamine resin particles. Preferred are silica particles, and cataclastic silica (shattered silica) particles are especially preferred.

The particle size of the fine particles preferably is in the range of 0.01 to 5 μm (especially 0.01 to 3 μm). The particles of more than 5 μm bring about reduction of smoothness of a surface of the film or excessive haze of the film due to occurrence of void in the film forming procedure. The particles of less than 0.01 μm bring about no improvement of lubricating properties. The fine particles preferably contain particles having a particle size of 0.1 to 1 mm, in an amount of 5 to 100 ppm.

Further, the fine particles preferably do not contain a particle of more than 1 μm and the amount of such large particles should not exceed 20% in proportion in terms of area. This means that particles of not less than 1 μm separated by a sieve should not exceed 20% based on the total particle in the area cumulative distribution curve. The particles of more than 1 μm are apt to produce void in the film, and therefore the fine particles containing particles of more than 1 μm in an amount of more than 20% in the proportion in terms of area is not favorably employed.

The cataclastic silica particles preferably contain particles pore volume of not more than 0.1 mL/g, especially in the range of 0.01 to 0.05 mL/g. Further, the cataclastic silica particles preferably have specific surface area of 10 to 30 m$^2$/g.

The cataclastic silica particles may be one obtained by shattering or pulverizing synthetic silica or natural silica such as natural quartz. The shattered product of natural quartz is preferred. Further, preferred is a shattered product of natural quartz which is subjected to no treatment for removing sharp edge. The treatment brings about reduction of edge having an acute angle. The shattered product of natural quartz are selected by classification to obtain the shattered product having the specific particle size mentioned above.

The cataclastic silica particles are preferably produced from natural silica of high purity. Therefore, the cataclastic silica particles preferably contain silicon dioxide at a high concentration. The concentration of the silicon dioxide preferably is not less than 99.5 weight %, especially 99.8 weight %.

In the invention, the polyester film may contain metal phosphate particles (internal particles) which are produced by reaction of a metallic compound and a phosphorus compound in the process of polymerization for preparing polyester.

The support (polyester film) of the photographic film of the invention preferably is a polyester film stretched in two directions (that is biaxially oriented polyester film). Polyester materials employed for forming the film are polyethylene-2,6-naphthalate (PEN), polyethylene terephthalate (PET) and/or a copolymer of ethylene-2,6-naphthalate and ethylene terephthalate. Combination of PEN and PET is advantageous because theses are easily available.

The biaxially oriented polyester film can be, for example, prepared in the following manner. The preparation is explained referring to the attached FIG. 1 (FIG. 1).

The polyester material and the fine particles (preferably employed) are dried beforehand. The drying is generally conducted at a temperature of 80° to 180° C. for 12 to 36 hours. Otherwise, the drying is preferably in vaccuo in the case that it is conducted at a temperature of not higher than glass transition temperature of the polyester. The dried polyester material and the particles are introduced into an extruder 2 through a hopper 1. The inside of the extruder is generally heated to a temperature of 300° to 330° C. (preferably 305° to 325° C.) and the polyester material is mixed under melting in the extruder. The mixing under melting is generally performed for 3 or more minutes (preferably 3 to 20 minutes).

In the case that both of PEN and PET are used as polyester materials, it is preferred that the temperature of the inside of extruder is set in the range of 300° to 330° C. and the mixing time period is performed for 5 to 20 minutes (especially 5 to 7 minutes).

The melted polyester material (generally heated to a temperature of 300° to 330° C.) is fed to T die 3. The melted polyester material is preferably fed to T die 3 after the material is passed through a filter having a pore diameter of 1 to 100 $\mu$m. The melted polyester material is extruded from T die 3 on a casting drum (roll) 4 to give a sheet. The casting drum has a surface heated to a temperature of 30° to 110° C., and therefore the sheet formed on the casting drum is cooled to form an unstretched (amorphous) sheet.

Subsequently, the sheet is stretched in the lengthwise direction (machine direction) on heat rolls 6 between a slow driving roll 5 and a fast driving roll 7. The stretching in a lengthwise direction is generally carried out as much as 2.0 to 5.0 times (preferably 2.5 to 4.0 times), at temperature of 100° to 160° C. (preferably 100° to 140° C.). Then, the stretched sheet is cooled on a cooling roll 8, and stretched in a width direction (traverse direction) by a crosswise stretching machine 9 into which a hot-air 10 is introduced, the stretching in the width direction being generally carried out as much as 2.0 to 5.0 times (preferably 2.8 to 4.5 times) and at a temperature of 110° to 160° C. (preferably 110° to 150° C.). Subsequently, the bi-axially stretched sheet is subjected to a heat treatment at a temperature of 160° to 290° C. (preferably 220° to 270° C.), and cooled in a cooling machine 11 to prepare a biaxially stretched polyester film. Further, the biaxially stretched polyester film is wound up by a wind-up machine 12. The wound polyester film is generally subjected to an annealing treatment at a temperature of not higher than the glass transition temperature of the polyester.

The polyester film prepared by the above-mentioned process (particularly polyester treated under heating at a high temperature) has recurring units comprising 60 to 85 molar % (preferably 60 to 80 molar %) of the ethylene-2, 6-naphthalate unit and 15 to 40 molar % (preferably 20 to 40 molar %) of the ethylene terephthalate unit and satisfies the formula (1). Thus prepared polyester film exhibits an curl value and loop stiffness suitable for the 135 type film.

In more detail, an ordinary PEN film shows a low curling tendency and gives a low core set curl value. However, a PEN film having a thickness suitable for a 135 type film (e.g., approx. 120 $\mu$m) exhibits a high stiffness (i.e., high loop stiffness). When the PEN film is employed as the support of the 135 type film, troubles such as jamming occur when the 135 type film is automatically loaded or wound up in a camera. Further, the high stiffness causes scratching and out-of-focusing in the course of the printing step for forming an image on a photographic printing paper, or jamming in the course of feeding the film in the printing step.

To solve the above problems, the present inventors have studied for imparting flexibility to the PEN film (e.g., to give a core-set curl value of not more than 40 $m^{-1}$ and a loop stiffness of 25 to 50 g). As a result, it has been revealed that if a terephthalate unit is incorporated into polyethylene-2, 6-naphthalate (PEN) and set to have ester bonding conditions to satisfy the specific condition of the formula (1), hardness originating from PEN is reduced. Hence, the resultant polyester film meets to the requirements for a support of 135 type film. The film can be advantageously obtained by the above specific process comprising the specific drying conditions, melting conditions and stretching conditions.

Thus, the support of the photographic film of the invention preferably has a core-set curl value of not more than 40 $m^{-1}$ (preferably 5 to 40 $m^{-1}$) and preferably has a loop stiffness of 25 to 50 g (preferably 30 to 50 g). The loop stiffness indicates the stiffness of the film. The Acore-set curl value indicates tend of curling tendency.

The polyester film is greatly improved in the curling property and it shows low curling tendency. Thus, in the case that the photographic film having the polyester film is incorporated into a camera, tearing in perforation of the photographic film does not occur in the course of the winding-up procedure of the film, and folding or bending of the photographic film does not occur during the developing procedure.

In the invention, the biaxially stretched polyester film, is preferably subjected to a heat treatment (annealing treatment) before provision of a photographic layer, so that a free volume (strain) is relaxed. In more detail, a subbing layer is provided on the stretched polyester film, and further subjected to a heat treatment at temperature in the range of 50° C. to Tg (glass transition temperature) for 0.1 to 1,500 hours. The biaxially stretched polyester film may be subjected to the heat treatment, before the subbing layer is provided.

The effect of the heat treatment can be easily attained at a high temperature. However, the heat treatment at the temperature higher than the glass transition temperature (Tg) rather gives a film having high curling tendency. In more detail, the molecules in the film are apt to show random configuration by the heat treatment, which result in increase of free volume to give increase of fluidity of molecules. Hence, the heat treatment is preferably carried out at a temperature of lower than Tg.

The polyester film of the invention has a hydrophobic surface, and therefore it is difficult to firmly bond a photographic layer comprising a protective colloid mainly containing gelatin on the support.

Two processes are employable for the above difficulty:

(1) a process in which after providing a surface activation treatment such as a chemical treatment, a mechanical treatment, a corona discharge treatment, a flame treatment, a UV treatment, a high frequency wave treatment, a glow discharge treatment, an active plasma treatment, a laser treatment, a mixed acid treatment or an ozone oxidation treatment, a subbing layer is formed directly on the above-treated support by coating to obtain a high bonding strength and then a photographic emulsion layer is formed on the subbing layer to obtain a high bonding strength (or a photographic emulsion layer may be formed directly on the above-treated support by coating); and (2) a process in which a subbing layer is provided on the polyester film having been not surface-treated, and then a photographic emulsion layer is formed thereon.

It is assumed that any of these surface treatments are effected by forming some polar groups on the surface of a support which is originally hydrophobic and by increasing a cross linking density on the surface, and as a result, the affinity of the components contained in a subbing layer is increased or the bonding strength between the subbing layer and the support is enhanced. Further, there is known a multi-layer process in which a layer bonding strongly to a support (hereinafter referred to as the first subbing layer) is provided as the first layer and a hydrophilic resin layer bonding strongly to a photographic layer is provided thereon as the second layer. Also, known is a single layer process in which one resin layer containing both a hydrophobic group and a hydrophilic group is coated over the support.

In the multi-layer process, the first and second subbing layers are provided mentioned above. Examples of the known materials for the first subbing layer include copolymers derived from at least two of vinyl chloride, vinylidene chloride, butadiene, methacrylic acid, acrylic acid, itaconic acid and maleic anhydride; and various polymers. The second subbing layer is preferably formed of gelatin.

In the single layer process, a support is swollen on the surface and causes an internal mixing with a hydrophilic polymer of the subbing layer to obtain a high bonding strength in many cases. Examples of materials for the subbing layer include a water soluble polymer, cellulose ester, a latex polymer and a water soluble polyester. Examples of the water soluble polymers include gelatin, gelatin derivatives, casein, agar, sodium alginate, starch, polyvinyl alcohol, a copolymer of acrylic acid and other monomers and a copolymer of a maleic anhydride and other monomers. Examples of the cellulose ester include carboxymethyl cellulose and hydroxyethyl cellulose. Examples of the latex polymers include a copolymer of vinyl chloride and other monomers, a copolymer of vinylidene chloride and other monomers, a copolymer of acrylic acid ester and other monomers, a copolymer of vinyl acetate and other monomers and a copolymer of butadiene and other monomers. Gelatin is particularly preferred.

The binder of the back coat layer can be a hydrophobic polymer or a hydrophilic polymer. The back coat layer can contain an antistatic agent, a lubricant, a matting agent, a surfactant, a dye or the like.

The antistatic agent of the backing layer preferably is in the form of fine particles of at least one crystalline metal oxide selected from ZnO, $TiO_2$, $SnO_2$, $Al_2O_3$, $ln_2O_3$, $SiO_2$, MgO, BaO, $MoO_3$ and $V_2O$, or a composite metal oxide thereof. Binders of backing layer include a hydrophobic polymer or a hydrophilic polymer used for the subbing layer.

The photographic emulsion layer (silver halide emulsion layer) generally is used for either a black and white photographic material or a color photographic material. The photographic emulsion layer for color photographic material is described below.

The color photographic film generally has a red-sensitive emulsion layer, a green-sensitive emulsion layer and a blue-sensitive emulsion layer on the support. The order of those layers can be optionally determined. As a typical example, there can be mentioned a silver halide photographic material provided with plural silver halide emulsion layers (which are substantially same in their sensitivity), and the emulsion layers are a red-sensitive layer, a green sensitive layer and a blue sensitive layer. In the multi-layered silver halide color photographic material, the red-sensitive layer, the green sensitive layer and the blue sensitive layer are generally arranged from the support side in this order. The blue-sensitive layer, the green-sensitive layer and the red-sensitive layer may be arranged in this order from the support side. Further, the blue-sensitive layer, the red-sensitive layer and the green-sensitive layer may be arranged in this order from the support side. Further, two or more emulsion layers which are sensitive to the same color but show different sensitivities-can be provided to enhance the sensitivity. A non-light sensitive layer such as an intermediate layer may be interposed between two or more emulsion layers having the same color sensitivity.

The intermediate layer may contain couplers, DIR compounds and/or color mixture preventives.

Silver halide grains in the silver halide emulsion layer may be regular grains having a regular crystal shape such as a cube, octahedron or tetradecahedron, those having an irregular shape such as sphere or tablet, those having a crystal defect such as twinning plane, or those having a combination of various shapes.

The silver halide grains may be either fine grains of mot more than about 0.2 $\mu$m in the diameter or large grains having a projected area diameter of up to about 20 $\mu$m. The emulsion may be either a monodisperese emulsion or a poly-disperese emulsion.

A tabular silver halide grain having an aspect ratio of not less than 5 can also be employed in the invention.

The crystal structure may be either homogeneous or heterogeneous. In the heterogeneous structure, the halogen compositions positioned in the core or in the shell are different from each other. Some silver halide grains in which halogens are different from each other may be combined by epitaxial bond to form the crystalline structure, or a salt other than silver halide such as silver rhodanite and lead oxide also may be combined to the silver halide crystal by epitaxial bond. Mixture of grains having various crystal shapes also may be employed.

The emulsion used in the invention is usually subjected to physical ripening, chemical ripening and spectral sensitization. Additives used in these process are described in Research Disclosure No. 17643 (December, 1978) and ibid., No. 18716 (November, 1979).

Various color couplers can be used in the invention. Concrete examples of the couplers are described in the patents cited in *Research Disclosure No.* 17643, VII C-G.

In the photographic film, the total thickness of all hydrophilic colloid layers on the photographic emulsion side preferably is not more than 28 $\mu$m. The film swelling rate ($T_{1/2}$) is preferably not more than 30 seconds. The film thickness is determined after being stored at a temperature of 25° C. and a relative humidity of 55% for two days. The film swelling rate ($T_{1/2}$) can be determined by a known method in the art, for example, by using a swellometer of the type as described in A. Green et al, "Photographic Science and Engineering", Vol. 19, No. 2. pp. 124–129. $T_{1/2}$ is defined as the time required until the saturated film thickness (that is, 90% of the maximum swollen film thickness) reaches its half thickness reached when the photographic material is processed in a color developer at a temperature of 30° C. over 195 seconds.

A photographic layer is provided on the polyester film (support) to prepare a photographic film, and the film is cut to give a width of 35 mm to meet the requirements for the support of 135 type film.

In the invention, the diameter of the spool of the cartridge (patrone) around which the photographic film is wounded generally is in the range of 10 to 14 mm, preferably 11 to 13 mm.

The present invention is further described by the following examples. "Part(s)" in Examples and Comparison Examples means "weight part(s)".

SYNTHETIC EXAMPLE 1

[Preparation of polyethylene-2,6-naphthalate (PEN)]

Into a vessel for interesterification reaction, 100 parts of dimethyl 2,6-naphthalene dicarboxylate, 58 parts of ethylene glycol, 0.029 part of manganese acetate tetrahydrates and 0.028 part of antimony trioxide were introduced, and the mixture in the vessel was heated to 200° C. with stirring. Subsequently, the mixture was heated with removing methanol produced by the reaction of dimethyl 2,6-naphthalene dicarboxylate and ethylene glycol through a fractionating tower to reach 235° C. After completion of production of methanol, the resultant reaction mixture was transferred into a vessel for polycondensation, and 0.030 part of trimethyl phosphate was added to the reaction mixture. The reaction mixture was heated to 285° C. under gradually reducing the pressure in the vessel. The final pressure (degree of vacuum) in the vessel was 0.3 Torr. The reaction mixture was heated for 2 hours under the conditions of 285° C. and 0.3 Torr, to prepare polyethylene-2,6-naphthalate having an intrinsic viscosity of 0.60.

SYNTHETIC EXAMPLE 2

[Preparation of polyethylene terephthalate (PET)]

The procedures of Synthetic Example 1 were repeated except for using 80 parts of dimethyl terephthalate instead of 100 parts of dimethyl 2,6-naphthalene dicarboxylate, to prepare polyethylene terephthalate having an intrinsic viscosity of 0.58.

SYNTHETIC EXAMPLE 3

[Preparation of poly(ethylene-2,6-naphthalate/ethylene terephthalate) (copolymer)]

The procedures of Synthetic Example 1 were repeated except for using 80 parts of dimethyl 2,6-naphthalene dicarboxylate and 20 parts of dimethyl terephthalate instead of 100 parts of dimethyl 2,6-naphthalene dicarboxylate, to prepare poly(ethylene-2,6-naphthalate/ethylene terephthalate) having an intrinsic viscosity of 0.65.

EXAMPLE 1

Example 1 is explained referring FIG. 1.

Pellets of PEN obtained in Synthetic Example 1 and pellets of PET obtained in Synthetic Example 2 were mixed in such amounts that an ethylene-2,6-naphthalate unit was 76 molar % and an ethylene terephthalate unit was 24 molar %. The mixture was dried in vacuo at 160° C. for 19 hours, and the dried mixture was introduced from a hopper 1 into an extruder 2 equipped with a filter having 10 $\mu$m mesh. The mixture of pellets was melted and kneaded in the heated extruder for 4 minutes (residence time), and the melted polyester was fed to T die 3, and then the melted polyester of 310° C. was extruded to give a sheet from the T die onto a casting drum 4 having a surface temperature of 50° C., to prepare an unstretched sheet.

Subsequently, unstretched sheet was stretched as much as 3.2 times in a lengthwise direction at 110° C. by a heat roll 6 between a slow driving roll 5 and a fast driving roll 7, and after the stretched sheet was cooled by a cooling roll 8, the stretched sheet was stretched as much as 3.6 times in a width direction at 120° C. by a crosswise stretching machine 9 into which a hot-air 10 was introduced. Subsequently, the biaxially stretched sheet was subjected to a heat treatment of 235° C. for 2 seconds, and cooled in a cooling machine 11 to prepare a biaxially stretched polyester film.

EXAMPLES 2 and 3

The procedures of Example 1 were repeated except for changing the mixing ratio of PEN and PET, the extruding temperature and the residence time to those shown in Table 1 to prepare a biaxially stretched polyester film.

EXAMPLE 4

The procedures of Example 1 were repeated except for employing the copolymer prepared in Synthetic Example 3 instead of the combination of PEN and PET and changing the extruding temperature and the residence time to those shown in Table 1 to prepare a biaxially stretched polyester film.

EXAMPLE 5

The procedures of Example 3 were repeated except for adding 50 ppm of cataclastic silica particles (mean diameter: 0.5 $\mu$m) to the mixture of PEN and PET to prepare a bi-axially stretched polyester film.

COMPARISON EXAMPLES 1 to 3

The procedures of Example 1 were repeated except for changing the mixing ratio of PEN and PET, the extruding temperature and the residence time to those shown in Table 1 to prepare a biaxially stretched polyester film.

The resultant polyester films are measured according to the following measuring methods.

(1) Intrinsic viscosity The polyester film is dissolved in a mixed solvent of phenol and 1,1,2,2-tetrachloroethane (3/2. by weight), and viscosity of the solution is measured at 25° C. by Ubbellohde viscometer.

(2) Ester bonding condition

The polyester film is dissolved in a mixed solvent of hexafluoroisopropanol (substituted with deuterium) and chloroform (substituted with deuterium) (1/1, by volume) to prepare a solution having a concentration of 1 g/0.8 L. A one-dimensional spectrum of proton of the solution is determined according to a nuclear magnetic resonance (300MHz).

In the case that a signal of the chloroform is set to 7.26 ppm, peaks attributable to ethylene glycol are observed at approx. 4.7 ppm, 4.75 ppm and 4.8 ppm. The peak at 4.7 ppm is attributed to ethylene glycol having a residue of terephthalic acid on both sides (which is represented by [TET]), the peak at 4.75 ppm is attributed to ethylene glycol having a residue of terephthalic acid on one side and a residue of 2,6-naphthalene dicarboxylic acid on the other side (which is represented by [NET]), and the peak at 4.8 ppm is attributed to ethylene glycol having a residue of 2,6-naphthalene dicarboxylic acid at both sides (which is represented by [NEN]), and the proportion of the [NET] is calculated based on the areas of theses peaks (3) Core-set curl value The polyester film is allowed to stand for 24 hours at temperature of (Tg—5)° C. (Tg: glass transition temperature), and the resultant polyester film is cut to give a specimen in the form of belt of 35 mm×120 mm. The belt-shaped film (specimen) is wound around a tube made of polyvinyl chloride (diameter: 11.5 mm) by application of a tension of 100 gw, and allowed to stand for two hours at 80° C. and further left overnight at room temperature. Thereafter, the film is removed from the tube, and the removed film is dipped in water of 35° C. for three minutes and further left for one minute in a thermostat of 50° C. Then, a diameter of curl of the resultant film is measured. Core-set curl value of the film is represented by 1/R ($m^{-1}$) in which R is the diameter of curl of the film.

(4) Loop stiffness

The polyester film is allowed to stand for 24 hours at temperature of (Tg—5)° C. (Tg: glass transition temperature), and the resultant polyester film is cut to give a specimen in the form of belt of 10 mm×180 mm. A loop is formed using a 100 mm-in-length portion containing a central part of the band-shaped film (specimen), and a load produced when the loop is depressed from the outside until the loop formed a hollow of depth of 10 mm, is measured. The measurement is carried out using Loop Stiffness Tester (available.from Toyo Seiki Seisakusyo Co., Ltd.).

The results obtained by the above measurements are set forth in Tables 1-A and 1-B.

TABLE 1-A

| | *NA (molar ratio) | **Extr. Temp. (°C.) | ***Resi. Time (min.) | [NET] (molar ratio) | ****Ester bonding |
|---|---|---|---|---|---|
| Ex. 1 | 0.76 | 310 | 4 | 0.048 | −0.559 |
| Ex. 2 | 0.65 | 310 | 4 | 0.120 | −0.271 |
| Ex. 3 | 0.76 | 310 | 6 | 0.143 | −0.080 |
| Ex. 4 | 0.76 | 310 | 4 | 0.319 | 0.264 |
| Ex. 5 | 0.76 | 310 | 6 | 0.143 | −0.080 |
| Co. Ex. 1 | 0.76 | 295 | 4 | 0.031 | −0.749 |
| Co. Ex. 2 | 0.60 | 295 | 4 | 0.053 | −0.686 |
| Co. Ex. 3 | 0.76 | 310 | 2 | 0.032 | −0.735 |

Note
*NA: 2,6-Ethylenenaphthalate unit
**Extr.: Extruding
***Resi.: Residence
****Ester bonding: [NDA] + log[NET]

TABLE 1-B

| | Intrinsic viscosity | Loop Stiffness (g) | Curl Value ($m^{-1}$) | Thickness of film (μm) | Tg (°C.) |
|---|---|---|---|---|---|
| Ex. 1 | 0.53 | 46 | 21 | 120 | 108 |
| Ex. 2 | 0.55 | 40 | 30 | 120 | 100 |
| Ex. 3 | 0.48 | 44 | 17 | 120 | 104 |
| Ex. 4 | 0.62 | 42 | 12 | 120 | 102 |
| Ex. 5 | 0.48 | 44 | 17 | 120 | 104 |
| Co. Ex. 1 | 0.56 | 54 | 10 | 120 | 111 |
| Co. Ex. 2 | 0.57 | 45 | 45 | 120 | 97 |
| Co. Ex. 3 | 0.59 | 52 | 9 | 120 | 110 |

On the resultant supports, a subbing layer, a back layer and a photographic layer were provided to prepare photographic films, and the evaluations (5) to (7) were carried out for the resultant photographic films, as described later.

1) Provision of Subbing Layer

The resultant support was subjected to heat treatment (at a temperature lower than Tg by 5° C.) set forth in Table 3. Both sides of the support was subjected to a corona discharging treatment before a subbing layer was coated on one side of the support as described below.

The coating solution for a subbing layer having the following composition was coated on the treated surface of the support in the amount of 10 ml/$m^2$.

Subbina Layer Composition:

| | |
|---|---|
| Gelatin | 1.0 weight part |
| Salicylic acid | 0.3 weight part |
| Formaldehyde | 0.05 weight part |
| p-$C_9H_{19}C_6H_4O(CH_2CH_2O)_{10}H$ | 0.1 weight part |
| Distilled water | 2.2 weight parts |
| Methanol | 96.35 weight parts |

2) Provision of Back Coat Layer:

The back coat layer of the following composition was coated on the side opposite to the subbing layer coated side of the support.

2-1) Preparation of a Conductive Fine Particle Dispersion (tin oxide-antimony oxide composite dispersing solution):

230 parts by weight of stannic chloride and 23 parts by weight of antimony trichloride were dissolved in 3,000 parts by weight of ethanol to obtain a homogeneous solution. 1N Aqueous sodium hydroxide solution was dropwise added to the homogeneous solution until pH of the above solution reached 3 to obtain the coprecipitate of colloidal stannic oxide and antimony oxide. The coprecipitate was left standing at 50° C. for 24 hours to obtain a red brown colloidal precipitate.

The red brown colloidal precipitate was separated by centrifugation. Water was added to the precipitate to wash it by centrifugation in order to remove excessive ions. This operation was repeated three times to remove the excessive ions.

200 parts by weight of the colloidal precipitate from which the excessive ions were removed was dispersed once again in 1,500 parts by weight of water, and the dispersion was sprayed into a kiln heated to 600° C., whereby the blue fine particle powder of the tin-oxide-antimony oxide having the average particle size of 0.1 μm was obtained. The volume receptivity of the particle was 25 Ω·cm.

After the mixed solution of 40 parts by weight of the above fine particle powder and 60 parts by weight of water was adjusted to pH 7.0 and roughly dispersed with a stirrer, it was dispersed in a horizontal type sand mill (Daino mill manufactured by WILLYA BACHOFENAG) for the residence time of 30 minutes, to prepare the desired dispersing solution.

2—2) Preparation and Provision of Backing Layer:

The following composition [A] was coated on the support and dried at 115° C. for 60 seconds, so as to give a dry layer having a thickness of 0.3 μm. The following coating solution [B] for covering was further coated thereon and dried at 115° C. for 3 minutes to give a dry layer having a thickness of 0.1 μm.

Composition [A]:

| | |
|---|---|
| Above conductive fine particle dispersion | 10 weight parts |
| Gelatin | 1 weight part |
| Water | 27 weight parts |
| Methanol | 60 weight parts |
| Resorcin | 2 weight parts |
| Polyoxyethylene nonylphenyl ether | 0.01 weight part |

Composition [B]:

| | |
|---|---|
| Cellulose triacetate | 1 weight part |
| Acetone | 70 weight parts |
| Methanol | 15 weight parts |

-continued

| | |
|---|---|
| Dichloromethane | 10 weight parts |
| p-Chlorophenol | 4 weight parts |
| Silica particle (mean particle size: 0.2 μm) | 0.01 weight part |
| Polysiloxane | 0.005 weight part |
| $C_{15}H_{31}COOC_{40}H_{81}/C_{50}H_{101}O(CH_2CH_2O)_{16}H$ (8/2 weight ratio, mean particle size: 20 nm, dispersion) | 0.01 weight part |

3) Provision of the Photographic Emulsion Layer:

Subsequently, photographic emulsion layers having the following compositions were simultaneously coated on the subbing layer, to form a multi-layer color light-sensitive material.

Composition of Light Sensitive Layers:

Materials used for the light-sensitive layers are classified as follows:

| | |
|---|---|
| ExC: Cyan coupler | UV: UV absorber |
| ExM: Magenta coupler | HBS: High boiling solvent |
| ExY: Yellow coupler | H: Gelatin hardener |
| ExS: Sensitizing dye | |

The composition and its amount ($g/m^2$) of each of the layers are set forth below. The amount of each component means the coating amount. The values for the silver halide emulsion mean the coating amount in terms of silver. As for the sensitizing dyes, the coating amount per one mole of the silver halide in the same layer is shown in terms of mole.

First layer (antihalation layer):

| | |
|---|---|
| Black colloidal silver | 0.18 |
| Gelatin | 1.40 |
| ExM-1 | 0.18 |
| ExF-1 | $2.0 \times 10^{-3}$ |
| HBS-1 | 0.20 |

Second layer (intermediate layer):

| | |
|---|---|
| Emulsion G | silver: 0.065 |
| 2,5 Di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |

Third layer (low-sensitivity red sensitive emulsion layer):

| | |
|---|---|
| Emulsion A | silver: 0.25 |
| Emulsion B | silver: 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-7 | 0.0050 |
| ExC-8 | 0.010 |
| Cpd-2 | 0.025 |
| HBS-1 | 0.10 |
| Gelatin | 0.87 |

Fourth layer (middle-sensitivity red sensitive emulsion layer):

| | |
|---|---|
| Emulsion D | silver: 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.010 |
| Gelatin | 0.75 |

Fifth layer (high-sensitivity red sensitive emulsion layer):

| | |
|---|---|
| Emulsion E | silver: 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-8 | 0.025 |
| Cpd-2 | 0.050 |
| HBS-1 | 0.22 |
| HES-2 | 0.10 |
| Gelatin | 1.20 |

Sixth layer (Intermediate layer):

| | |
|---|---|
| Cpd-1 | 0.10 |
| HBS-1 | 0.50 |
| Gelatin | 1.10 |

Seventh layer (low-sensitivity green sensitive emulsion layer):

| | |
|---|---|
| Emulsion C | silver: 0.35 |
| ExS-4 | $3.0 \times 10^{-5}$ |
| ExS-5 | $2.1 \times 10^{-4}$ |
| ExS-6 | $8.0 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |

Eighth layer (middle-sensitivity green sensitive emulsion layer):

| | |
|---|---|
| Emulsion D | silver: 0.80 |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.90 |

Ninth layer (high-sensitivity green sensitive emulsion layer):

| | |
|---|---|
| Emulsion E | silver: 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |

Tenth layer (yellow filter layer)

| | |
|---|---|
| Yellow colloidal silver | silver: 0.030 |
| Cpd-1 | 0.16 |
| HBS-1 | 0.060 |
| Gelatin | 0.60 |

Eleventh layer (low-sensitivity blue sensitive emulsion layer):

| | |
|---|---|
| Emulsion C | silver: 0.18 |
| ExS-7 | $8.6 \times 10^{-4}$ |
| ExY-1 | 0.020 |
| ExY-2 | 0.22 |
| ExY-3 | 0.50 |
| ExY-4 | 0.020 |
| HBS-1 | 0.28 |
| Gelatin | 1.10 |

Twelfth layer (middle-sensitivity blue sensitive emulsion layer):

| | |
|---|---|
| Emulsion D | silver: 0.40 |
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |
| Gelatin | 0.78 |

Thirteenth layer (high-sensitivity blue sensitive emulsion layer):

| | |
|---|---|
| Emulsion F | silver: 1.00 |
| ExS-7 | $4.0 \times 10^{-4}$ |
| ExY-2 | 0.010 |
| ExY-3 | 0.010 |
| HBS-1 | 0.070 |
| Gelatin | 0.86 |

Fourteenth layer (first protective layer):

| | |
|---|---|
| Emulsion G | silver: 0.20 |
| UV-4 | 0.11 |
| UV-5 | 0.17 |
| HBS-1 | 0.050 |
| Gelatin | 1.00 |

Fifteenth layer (second protective layer):

| | |
|---|---|
| H-1 | 0.40 |
| B-1 (diameter: 1.7 μm) | 0.050 |
| B-2 (diameter: 1.7 μm) | 0.10 |
| B-3 | 0.10 |
| S-1 | 0.20 |
| Gelatin | 1.20 |

Each layer containing the compounds of W-1 to W-3, B-4 to B-6, F-1 to F-17, an iron salt, a lead salt, a gold salt, a platinum salt, an iridium salt and/or a rhodium salt, in order to improve preservation performance, processing performance, antipressure performance, antimold and fungicidal performance, antistatic performance, and coating performance.

Emulsion composition used in each layer set forth in Table 2.

TABLE 2

| | mean AgI content (%) | mean grain size (μm) | coefficient of variation (%) | diameter/thickness | silver ratio [core/middle/shell](AgI content) | grain structure/form |
|---|---|---|---|---|---|---|
| A | 4.0 | 0.45 | 27 | 1 | [1/3] (13/1) | double/octahedron |
| B | 8.3 | 0.70 | 14 | 1 | [3/7] (25/2) | double/octahedron |
| C | 2.0 | 0.55 | 25 | 7 | — | even/tabular |
| D | 9.0 | 0.65 | 25 | 6 | [12/59/29] (0/11/8) | triple/tabular |
| E | 9.0 | 0.85 | 23 | 5 | [8/59/33] (0/11/8) | triple/tabular |
| F | 14.5 | 1.25 | 25 | 3 | [37/63] (34/3) | double/tabular |
| G | 1.0 | 0.07 | 15 | 1 | — | even/tabular |

In Table 2;

(1) Emulsions A to F were subjected to reduction sensitization with thiourea dioxide and thiosulfonic acid in the preparation of the grains according to the examples described in Japanese Patent Provisional Publication H. 2-191938.

(2) Emulsions A to F were subjected to a gold sensitization, a sulfur sensitization and a selenium sensitization in the presence of the spectral sensitizing dyes described in the respective layers and sodium thiocyanate according to the examples of Japanese Patent Provisional Publication H. 3-237450.

(3) Low molecular weight gelatin was used in the preparation of the tabular grains according to the examples described in Japanese Patent Provisional Publication H. 1-158426.

(4) The dislocation lines described in Japanese Patent Provisional Publication H. 3-237450 were observed in the tabular grains and regular crystal grains having a grain structure according to a high voltage electron microscope observation.

The abbreviations of the components used in the respective layers mean the following compounds:

ExC-1
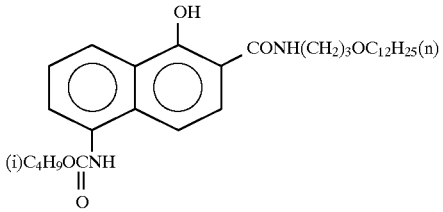
ExC-2
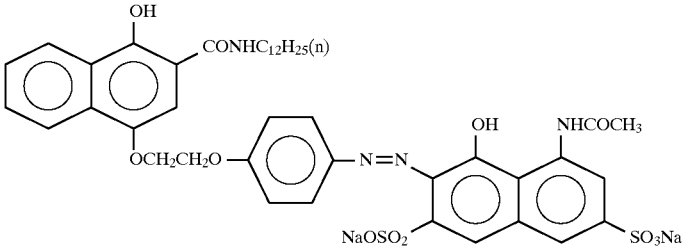
ExC-3
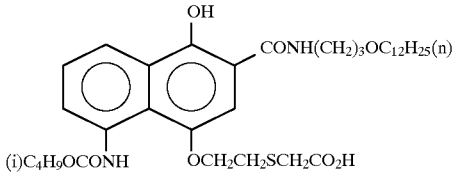
ExC-4
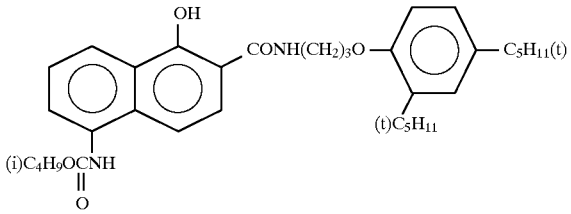
ExC-5
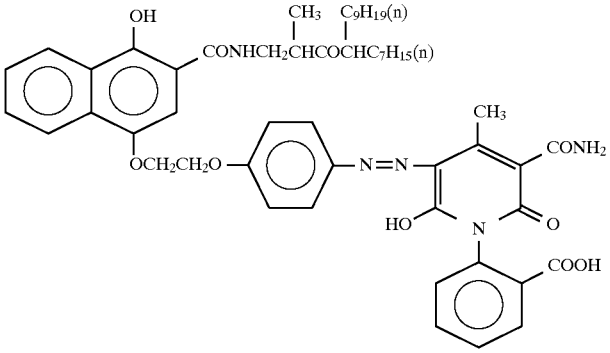
ExC-6
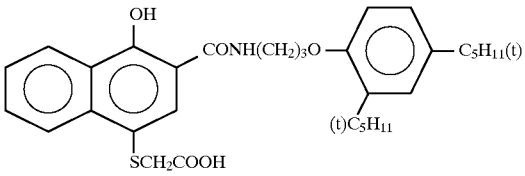

-continued
ExC-7
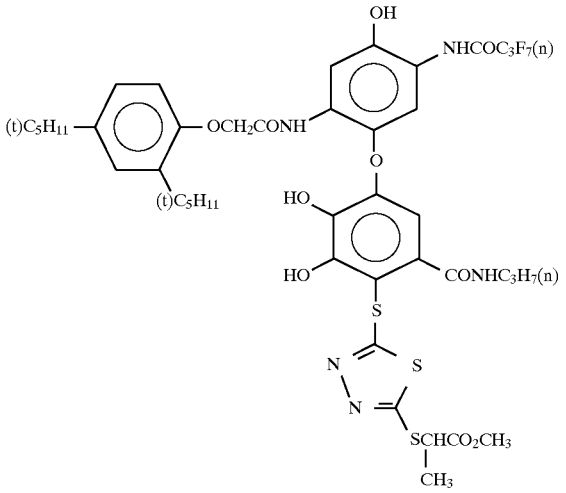
ExC-8
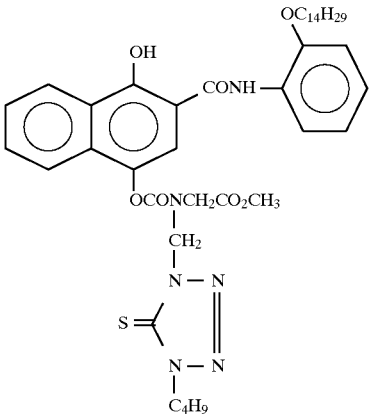
ExM-1
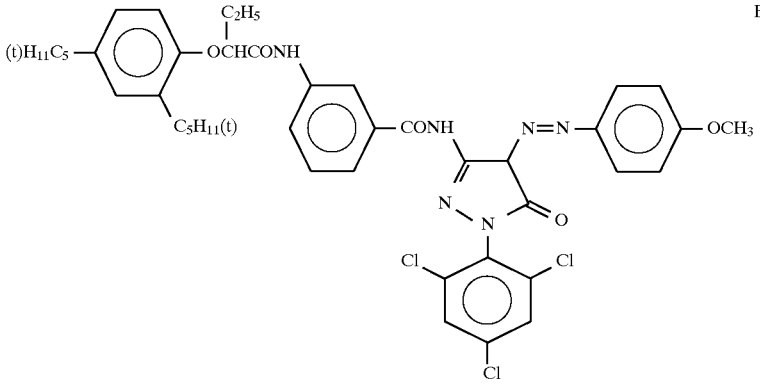

-continued
ExM-2
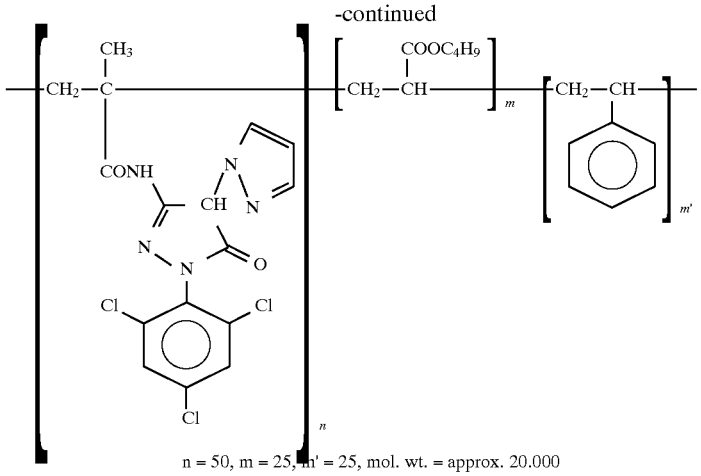
n = 50, m = 25, m' = 25, mol. wt. = approx. 20.000
ExM-3
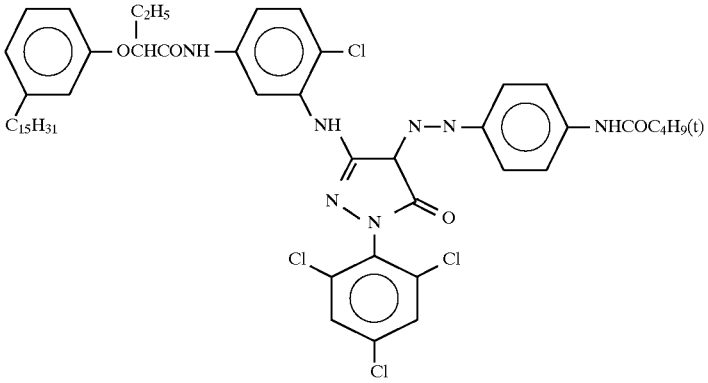
ExM-4
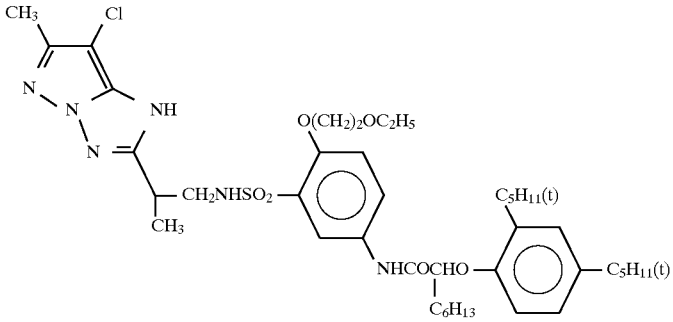
ExM-5
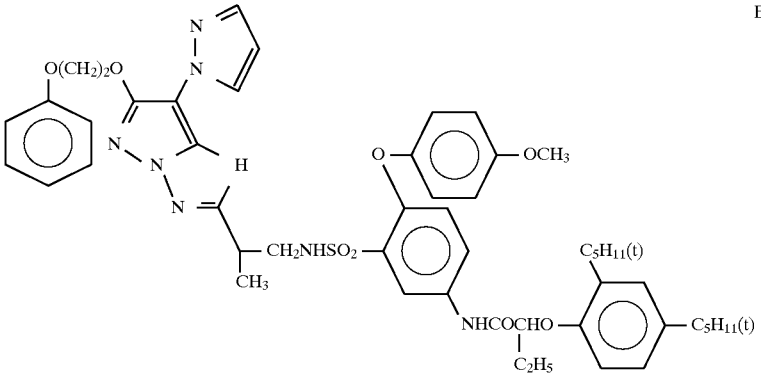

-continued
ExY-1
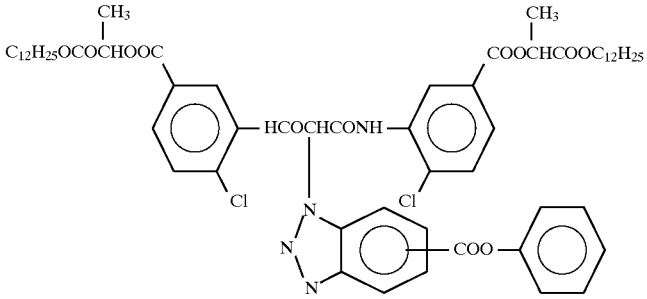
ExY-2
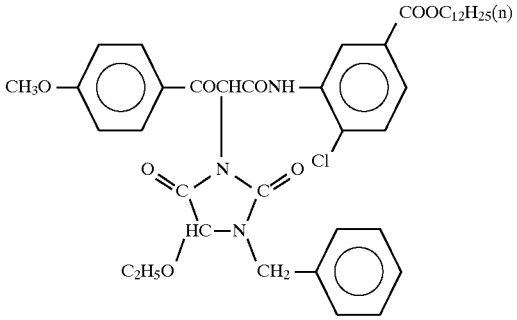
ExY-3
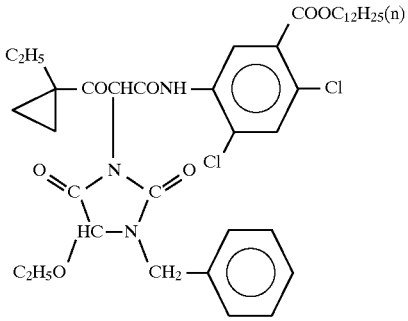
ExY-4
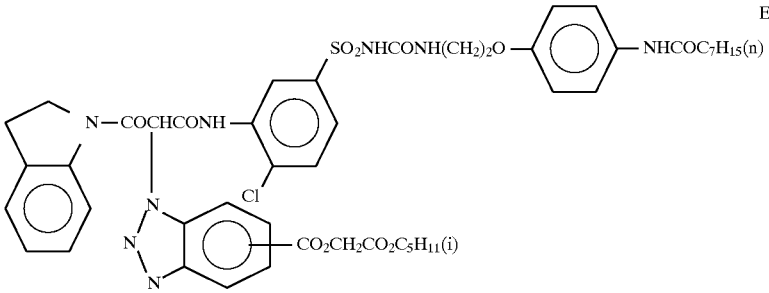
ExF-1
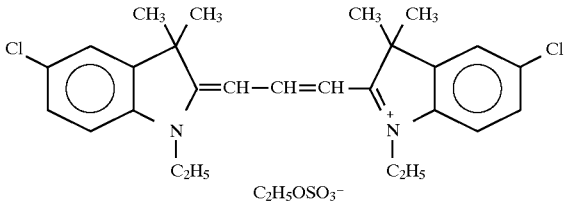

-continued
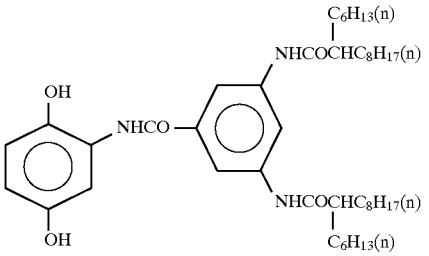
Cpd-1
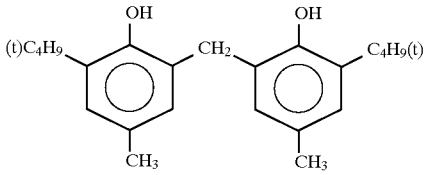
Cpd-2
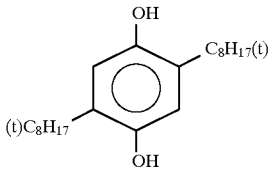
Cpd-3
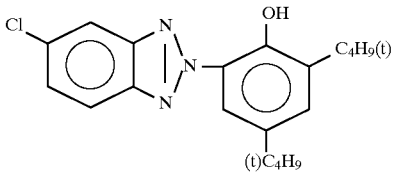
UV-1
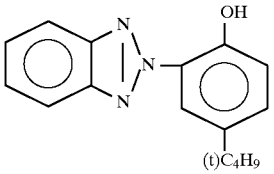
UV-2
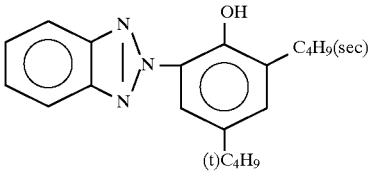
UV-3
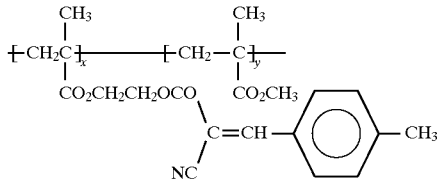
x:y = 70:30 (weight %)
UV-4
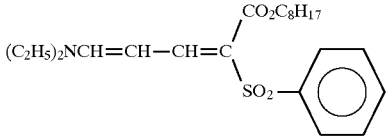
UV-5
Tricresyl phosphate HBS-1
Di-n-butyl phthalate HBS-2

-continued
HBS-3
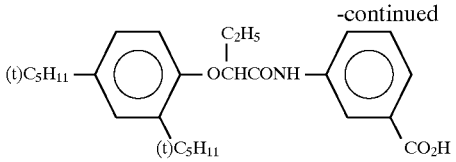
ExS-1
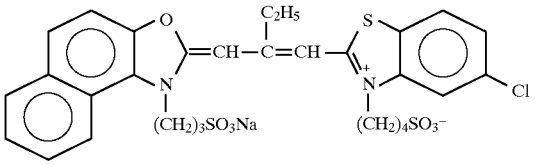
ExS-2
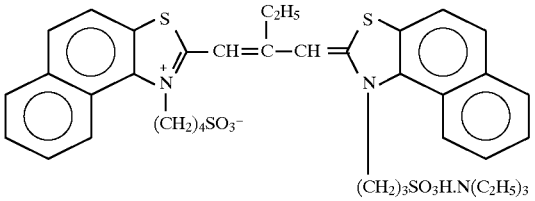
ExS-3
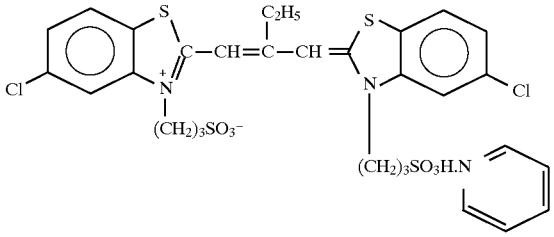
ExS-4
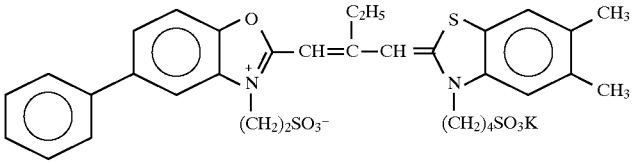
ExS-5
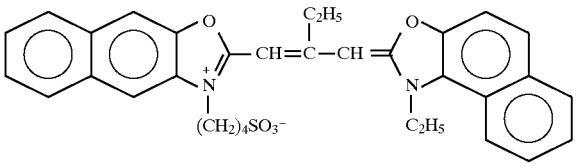
ExS-6
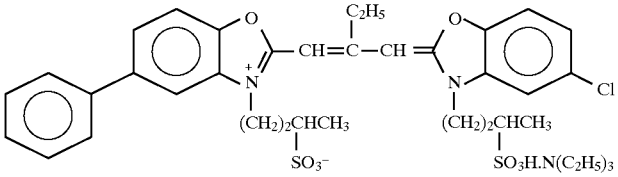
ExS-7
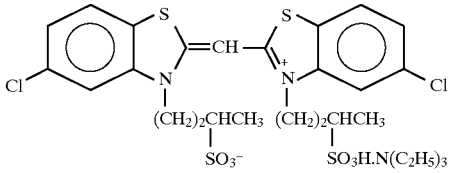
S-1
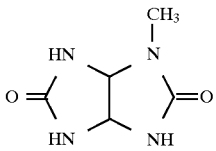

-continued
H-1
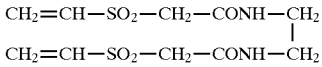
B-1
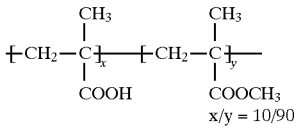
B-2
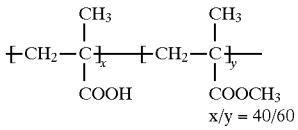
B-3
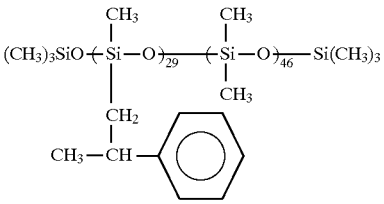
B-4
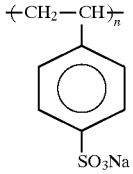
B-5
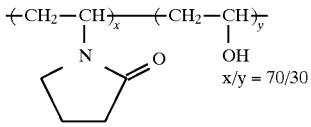
B-6
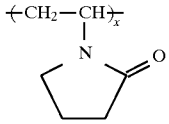
Molecular weight = approx. 10,000
W-1
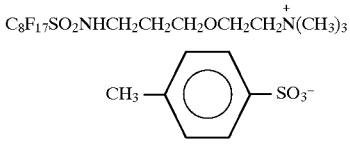
W-2
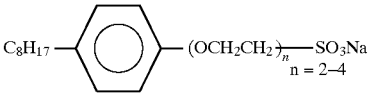
W-3
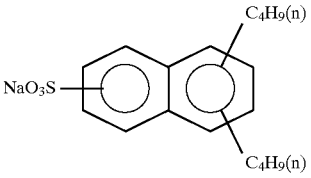
F-1
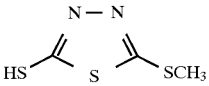

-continued
F-2
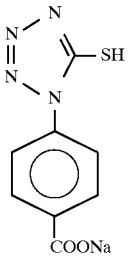
F-3
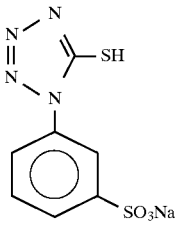
F-4
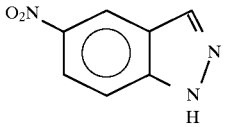
F-5
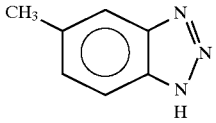
F-6
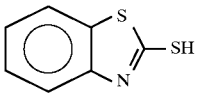
F-7
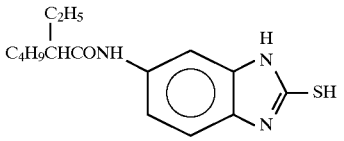
F-8
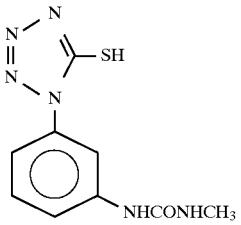
F-9
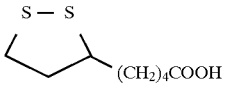
F-10
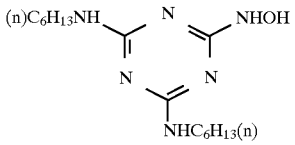
F-11
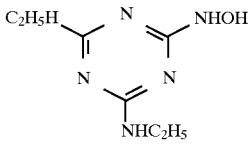

-continued

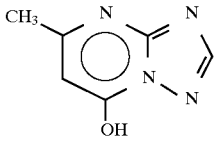

F-12

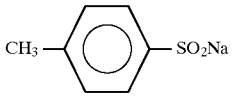

F-13

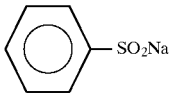

F-14

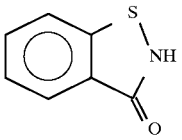

F-15

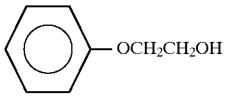

F-16

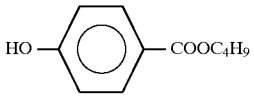

F-17

4) Preparation of photographic film The resultant photographic film was slit to the dimension defined in JIS K 7519-1982 to prepare a rolled strip film having a width of 35 mm which was wound around a spool having a diameter of 11.5 mm. The obtained film was incorporated into a patrone satisfying the dimensions defined in JIS K 7519-1982.

The following characteristics (5) to (7) were evaluated on the obtained patrone having the film.

(5) Occurrence of spots after developing treatment

The patrone having the film was subjected to a developing using an automatically developing machine. Spots produced by the developing treatment were observed and ranked as follows:

AA: no produced spots are observed

BB: some spots are observed.

(6) Operation of a patrone-incorporated camera

The patrone having the film was placed in a camera, and automatically loading and winding of the film were carried out. During the loading and winding procedures, occurrence of jamming of the film was observed and ranked as follows:

AA: no jamming is noted

BB: jamming is noted.

(7) Occurrence of out-of-focusing

The patrone having the film was loaded in a camera, and a photographic image was taken using the camera. The resultant film was subjected to a developing treatment and the obtained film was subjected to observation on out-offocusing and ranked as follows:

AA: no out-of-focusing is observed

BB: out-of-focusing is observed.

The results by the above measurements are set forth in Table 3.

TABLE 3

| | *NA (molar ratio) | [NET] (molar ratio) | Thickness (μm) | Spots | Operation | Out-of-focus | Heat treatment (°C./hours) |
|---|---|---|---|---|---|---|---|
| Ex. 1 | 0.76 | 0.048 | 120 | AA | AA | AA | 103/24 |
| Ex. 2 | 0.65 | 0.120 | 120 | AA | AA | AA | 95/24 |
| Ex. 3 | 0.76 | 0.143 | 120 | AA | AA | AA | 99/24 |
| Ex. 4 | 0.76 | 0.319 | 120 | AA | AA | AA | 97/24 |
| Ex. 5 | 0.76 | 0.143 | 120 | AA | AA | AA | 99/24 |
| Co. Ex. 1 | 0.76 | 0.031 | 120 | AA | BB | AA | 106/24 |
| Co. Ex. 2 | 0.60 | 0.053 | 120 | BB | AA | AA | 92/24 |
| Co. Ex. 3 | 0.76 | 0.032 | 120 | AA | BB | AA | 105/24 |

As is apparent from Tables 1A, 1B and 3, when a photographic film employing as a support a polyester film which has the specific composition, the specific conditions of ester bonding and the specific thickness is employed as a 135 type film for incorporating into a patrone, the photographic film shows good operation properties, and the resultant photographic image after development has no spot and does not show out-of-focusing.

In Comparison Examples 1 to 3, a photographic film employs as a support of a 135 type film a polyester film which has the composition of the invention but does not satisfy the specific conditions of ester bonding. Polyester films of Comparison Examples 1 and 3 are hard films and therefore the photographic films incorporated into the camera show poor operation (handling) properties. Though a polyester film of Comparison Example 2 is relatively flexible, the photographic film shows a high coreset curl value and therefore certain spots are produced after development.

What is claimed is:

1. A photographic film having a width of 35 mm which comprises a continuous support comprising polyester and at least one photographic layer provided thereon, wherein the polyester has recurring units comprising 60 to 85 molar % of ethylene-2,6-naphthalate unit and 15 to 40 molar % of ethylene terephthalate unit and satisfies the formula (1):

$$-0.65 \leqq [NDA] + \log [NET] \leqq 0.28 \quad (1)$$

wherein [NDA] represents a ratio of a number of 2,6-naphthalate unit to a total number of 2,6-naphthalate unit and terephthalate unit, and [NET] represents a ratio of a number of ethylene unit which has a 2,6-naphthalate unit on one side and a terephthalate unit on the other side to a total number of an ethylene unit in the polyester; and the support has a thickness of 112 to 128 $\mu$m.

2. The photographic film of claim 1, wherein the support is a biaxially stretched film.

3. The photographic film of claim 1, wherein the polyester has an intrinsic viscosity of 0.45 to 0.65.

4. The photographic film of claim 1, wherein the support further contains fine particles having a mean particle size of 0.1 to 1 $\mu$m in an amount of 5 to 100 ppm.

5. The photographic film of claim 1, wherein the support is in the form of rolled strip.

* * * * *